US005578430A

United States Patent [19]

Fyson

[11] Patent Number: 5,578,430

[45] Date of Patent: Nov. 26, 1996

[54] METHOD OF PROCESSING PHOTOGRAPHIC SILVER HALIDE MATERIALS WITHOUT REPLENISHMENT

[75] Inventor: John R. Fyson, Hackney, United Kingdom

[73] Assignee: Eastman Kodak Company, Rochester, N.Y.

[21] Appl. No.: 436,510

[22] Filed: May 8, 1995

[30] Foreign Application Priority Data

| | | | |
|---|---|---|---|
| Jul. 30, 1994 | [GB] | United Kingdom | 9415429 |
| Jul. 30, 1994 | [GB] | United Kingdom | 9415430 |
| Dec. 1, 1994 | [GB] | United Kingdom | 9424288 |

[51] Int. Cl.[6] ..... G03C 5/29; G03D 3/04

[52] U.S. Cl. ..... 430/401; 430/398; 430/399; 430/400; 430/30; 396/626; 396/630; 396/633

[58] Field of Search ..... 354/328, 329, 354/330; 430/398, 30, 399, 400, 401

[56] References Cited

U.S. PATENT DOCUMENTS

| | | | |
|---|---|---|---|
| 4,577,948 | 3/1986 | Lawson et al. | 354/299 |
| 5,440,365 | 8/1995 | Gates et al. | 354/298 |

FOREIGN PATENT DOCUMENTS

| | | | |
|---|---|---|---|
| 0600337A1 | 12/1992 | European Pat. Off. | G03C 5/26 |
| 93/11463 | 6/1993 | WIPO . | |
| 93/11461 | 6/1993 | WIPO | G03D 3/04 |

OTHER PUBLICATIONS

James, T. H., "The Theory of the Photographic Process", 4th ed. pp. 408–411, New York, 1977.

Keller, Karlheinz, "Science and Technology of Photography", pp. 129–130, Weinheim, 1993.

*Primary Examiner*—Mark F. Huff
*Attorney, Agent, or Firm*—J. Lanny Tucker

[57] ABSTRACT

A method of processing an imagewise exposed photographic silver halide material in a machine containing a number of non-replenished processing tanks or processing tanks that are supplied from a non-replenished source, the method wherein the silver halide comprises at least 95% by weight silver chloride and processing in each tank is carried out with sufficient agitation to avoid the need for replenishment.

11 Claims, 7 Drawing Sheets

METHOD OF PROCESSING PHOTOGRAPHIC SILVER HALIDE MATERIALS WITHOUT REPLENISHMENT

FIELD OF THE INVENTION

The invention relates to a method of processing a photographic silver halide material that enables non-replenished processing baths to provide images of non-varying quality.

BACKGROUND OF THE INVENTION

In the field of photographic processing it is well known to replenish processing solutions to compensate for loss of developer components by consumption by the process and aerial oxidation. Such a replenishment system requires replenisher pump(s), pipework and control means, all of which adds to the cost of the machine. Also, the control systems have to be calibrated to get constant sensitometry. In order to allow for errors in the calibration, the replenishment rate is often fixed at a relatively high rate. This means that much solution is wasted and is sent to a drain or an effluent tank for later disposal.

Some processing machines can be supplied by premixed solutions that are usually run until they produce unacceptable results and are not replenished hence avoiding the replenishment system described above.

U.S. Pat. No. 5,176,987 describes a method of developing a color photographic material that requires reduced developer replenishment by controlling the composition of the silver halide and the developer.

The problem experienced with such machines is that the quality of the images produced will deteriorate with continued use of the same solution. This means that the processing solutions must be discarded at a comparatively early stage if unvarying high quality processing is desired.

SUMMARY OF THE INVENTION

A method of processing an imagewise exposed photographic silver halide material in a machine containing a number of non-replenished processing tanks or processing tanks that are supplied from a non-replenished source, the method wherein the silver halide comprises at least 95% by weight silver chloride and processing in each tank is carried out with sufficient agitation to avoid the need for replenishment.

The method of processing does not require replenishment of the processing solution thereby reducing the amount of equipment required. The amount that the processing solution can be used before dumping, without sensitometry change, exceeds that known in the art.

BRIEF DESCRIPTION OF THE DRAWINGS

In the accompanying drawings, FIG. 1 is a schematic diagram of processing apparatus that may be used while

DETAILED DESCRIPTION OF THE INVENTION

Figure 1:
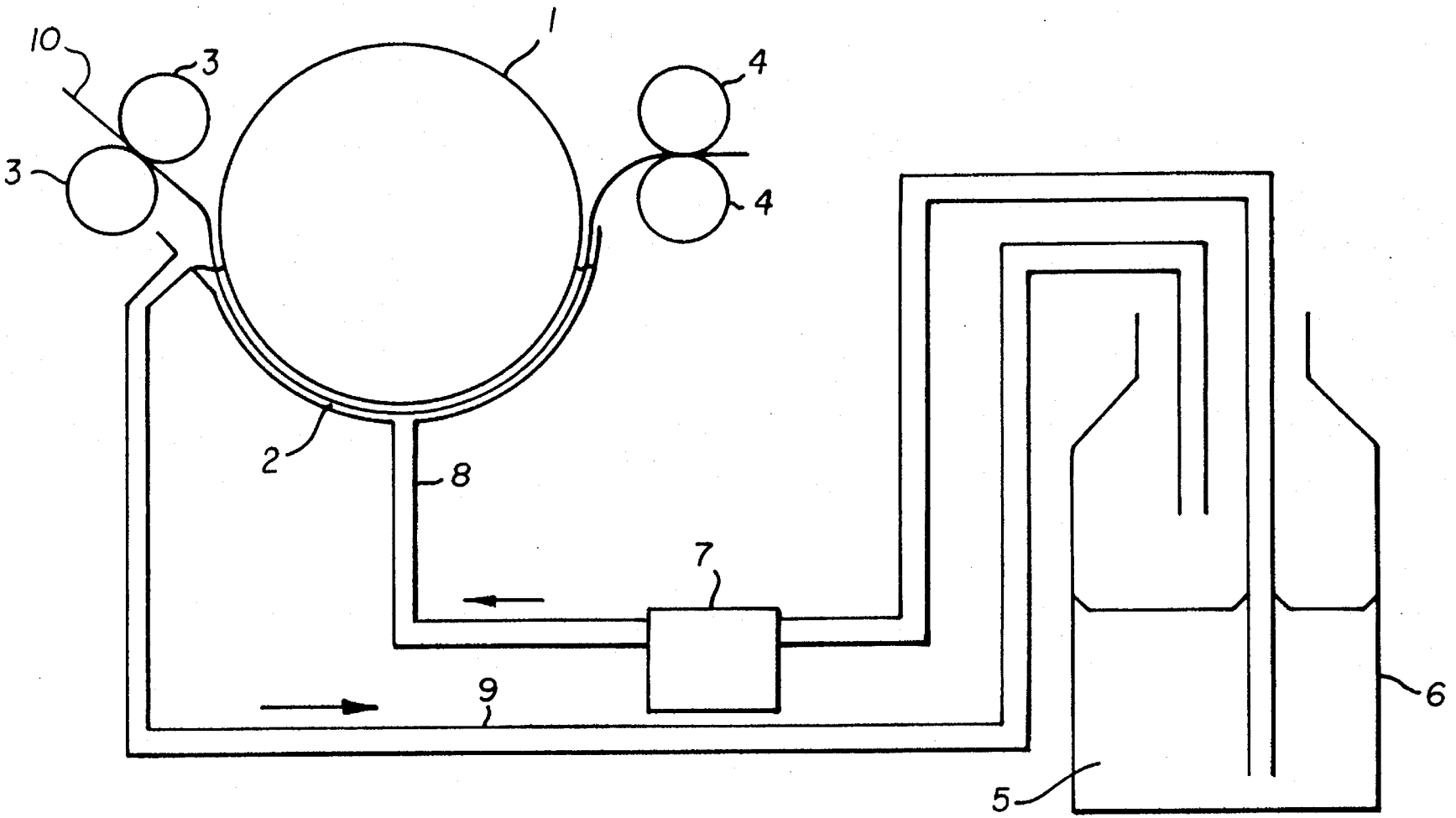

The present method applies to a wide variety of processing situations. For example, this would include the processing of either color or black-and-white photographic materials.

The present invention is particularly applicable to processing machines that accept a replaceable solution supply unit in which there are separate compartments holding the various solutions needed. Preferably one or more of the processing solutions are circulated between the supply unit and the processing tank continuously or intermittently. Using the invention, processing can be carried out for an unexpectedly long time using a fixed volume of processing solution in each processing stage without adding any replenisher.

Agitation of the processing solution refers to changing the processing solution on the surface of the silver halide material. In this way, old spent solution can be replaced with new fresh solution. Agitation of the processing solution as the silver halide material moves through the processing tank can be provided in a variety of ways, e.g., contacting the surface of the silver halide material immersed in processing solution with a rotating drum, providing sufficient rollers so that the number of roller strikes on the surface of the immersed silver halide material is >0.5/sec. or contacting the surface of the immersed silver halide material with a squeegee blade.

Preferably, the photographic material follows a serpentine path through the processing machine and the lowermost U-shaped regions of the path are used as tanks to receive the processing solutions. The path itself may be quite small, being only slightly larger than the dimensions of the photographic material that must pass along it. Thus, for example, where an elongate thin strip of photographic film or paper is being processed, the path may have a width that is just slightly greater than that of the film or paper and a depth of only a few millimeters.

In a particularly preferred embodiment of the invention, photographic processing apparatus is employed which includes at least one processing stage, each processing stage comprising:

a vessel;

a central rotating drum arranged within the vessel to define a processing tank, the clearance between the vessel and the drum being substantially constant; and at least one pair of drive rollers associated with the processing stage that is arranged to direct photographic material into and through the tank during processing.

The rollers are driven at a rate to ensure that processing is achieved as the material passes through the processing tank. Preferably, the speed of rotation of the drum is controlled independently of the speed of the drive rollers. The clearance between the vessel and the drum is preferably less than 5 mm, more preferably less than 2 mm.

This type of processing apparatus, referred to as a drum processor, can provide the high level of agitation required for the process of the invention.

Preferably, the surface of the drum moves at least 10 cm/sec. relative to the photographic material. Thus, the drum speed of a drum having a 30 cm circumference is preferably greater than 20 rpm.

Suitable drum processors are described in WO93/11464 and WO93/11463.

In FIG. 1 of the accompanying drawings the processing machine comprises a rapidly rotating processor drum (1) which rotates in a tank of small volume (2) having input transport rollers (3) and output transport rollers (4) through which the sheet of photographic material (10) is driven. The processing machine will also comprise other processing tanks (not shown) as is well understood. The processing solution (5) for tank (2) is held in reservoir (6) and is circulated by pump (7) through pipes (8) and (9) in the direction shown by the arrows.

Suitable silver halide photographic materials are those which show complete development to get the final image and the fog is produced only after extreme over development. Such materials comprise silver halide containing at least 95% by weight silver chloride. Any remaining silver halide present may be silver bromide. Essentially no silver iodide is present, i.e., less than 0.1% by weight. Preferably, the silver halide comprises at least 99% by weight silver chloride.

The photographic material to be processed by the present method may be a negative color material, e.g., a silver chloride color paper.

Typically, the photographic materials can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Photographic processing methods are described in Section XIX of Research Disclosure. Processing such materials in a processor with high agitation allows the process to be run for many sheets with no sensitometric change and no solution replenishment.

Using the process of the invention the amount that a processing solution can be used, without sensitometry change, far exceeds anything known in the art. For example, using known processing methods 500 ml of conventional developer solution (e.g., as described hereinafter in Example 1) will process up to 5 A4-sized prints. In contrast, the same amount of developer solution in the process of the invention can process at least 50 A4-sized prints.

The following Example is included for a better understanding of the invention. The volume of liquid described as the tank solution below is the sum of the volumes in the tank, the recirculation pipes and the reservoir.

The area of prints that can be processed in the system can be expressed in the following way for the developer and bleach-fix: Volume of tank solution=k×print area×carryover rate where k is a constant and >2.3, volumes are measured in ml, area in $m^2$ and carryover rate in $ml/m^2$.

EXAMPLE 1

In order to simplify the system, each part of a paper process was tested separately and modelling of the seasoned processes was used to save time.

All the model processing was carried out in a processing machine in which the photographic material experiences high agitation by contacting a rotating drum, similar to one made of several units described in PCT publication no. WO 93/11463.

Processing solutions were pumped continuously through the processor tanks by a peristaltic pump pumping 25 ml/min. One tank's recirculation system is shown in FIG. 1.

KODAK 'SUPRA'™ color paper, surface F, sheets of size A4 were used for testing. The silver halide comprised greater than 99% by weight silver chloride. This was exposed to a neutral 0.15 log exposure wedge.

The process sequence modelled was:

| Process | Time (seconds) | Temp. | Total tank + circulation volume |
|---|---|---|---|
| Develop | 30 | 40° C. | 500 ml |
| Bleach-fix | 30 | 22° C. | 500 ml |
| Stabilize | 15 | 22° C. | 500 ml |
| Stabilize | 15 | 22° C. | 500 ml |
| Stabilize | 15 | 22° C. | 500 ml |

The starting developer was one with the following formula (this is similar to RA4 replenisher):

| | |
|---|---|
| VERSA TL 71 (surfactant) | 0.25 ml |
| Triethanolamine | 11.0 ml |
| Diethylhydroxylamine | 6.0 ml |
| CD3* | 7.3 g |
| PHORWITE ™ REU (brightening agent) | 3.0 g |
| Disodium EDTA | 3.0 g |
| Catechol disulphonic acid | 3.0 g |
| Potassium chloride | 0.0 g |
| Potassium carbonate | 25.0 g |
| Water to | 1 liter |
| pH adjusted to 10.4 | |

*CD3 is 4-N-ethyl-N-(b-methanesulphonamidoethyl)-o-toluidine sesquisulphate.

Using 500 ml of liquid circulated through the processor and 100 prints exposed to give 1.3×normal average density, the following final seasoned developer concentration was calculated, if the system was not replenished:

| | |
|---|---|
| VERSA TL 71 | 0.25 ml |
| Triethanolamine | 11.0 ml |
| Diethylhydroxylamine | 4.0 ml |
| CD3* | 2.5 g |
| PHORWITE ™ REU | 3.0 g |
| Disodium EDTA | 3.0 g |
| Catechol disulphonic acid | 3.0 g |
| Potassium chloride | 9.0 g |
| Potassium carbonate | 25.0 g |
| Water to | 1 liter |
| pH adjusted to 9.9 | |

An intermediate developer composition (half seasoned) was tested which was made by mixing equal quantities of these two developers.

Figure 2:
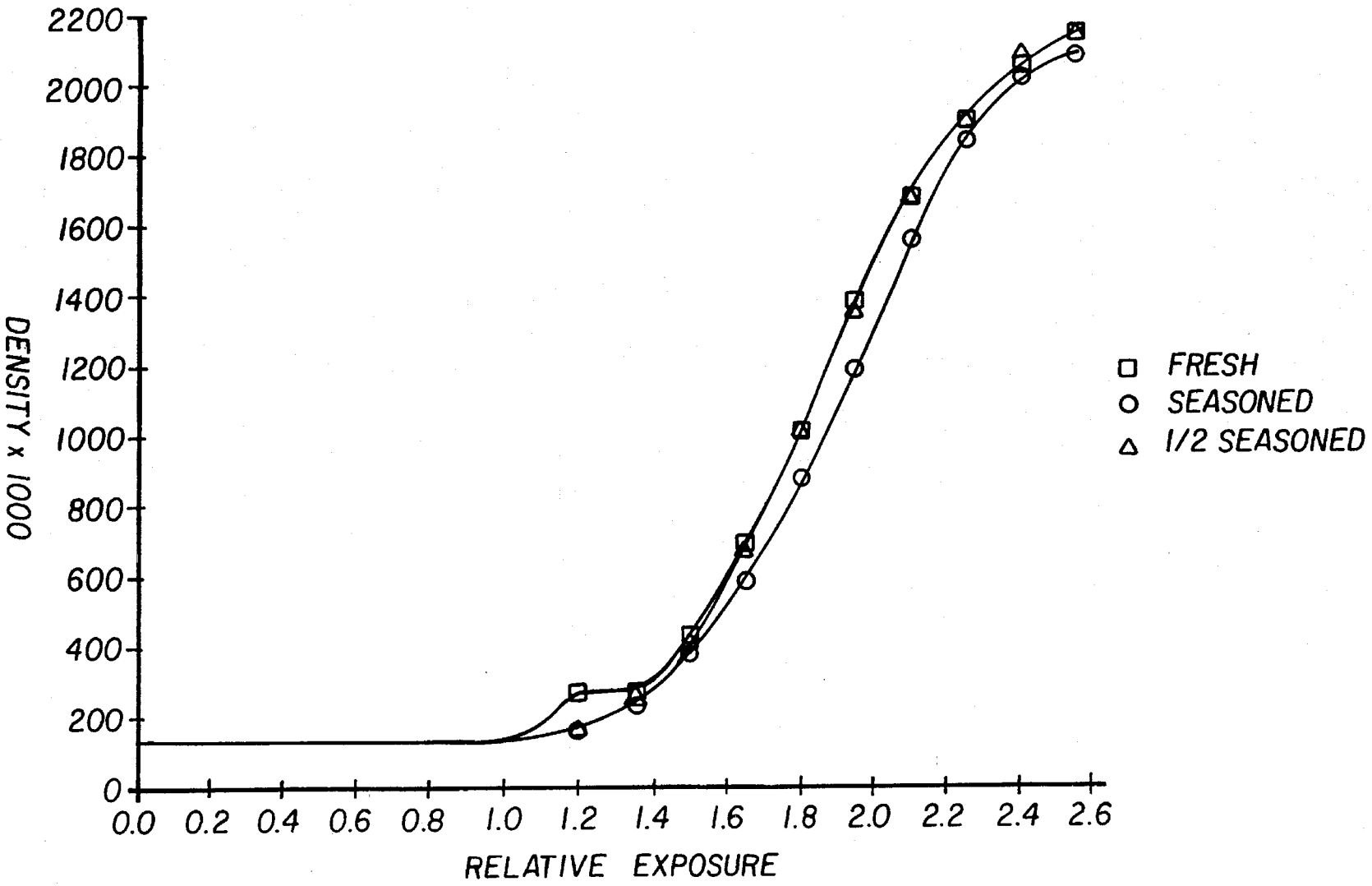
FIGS. 2 to 7 represent the results of the Examples.
Figure 3:
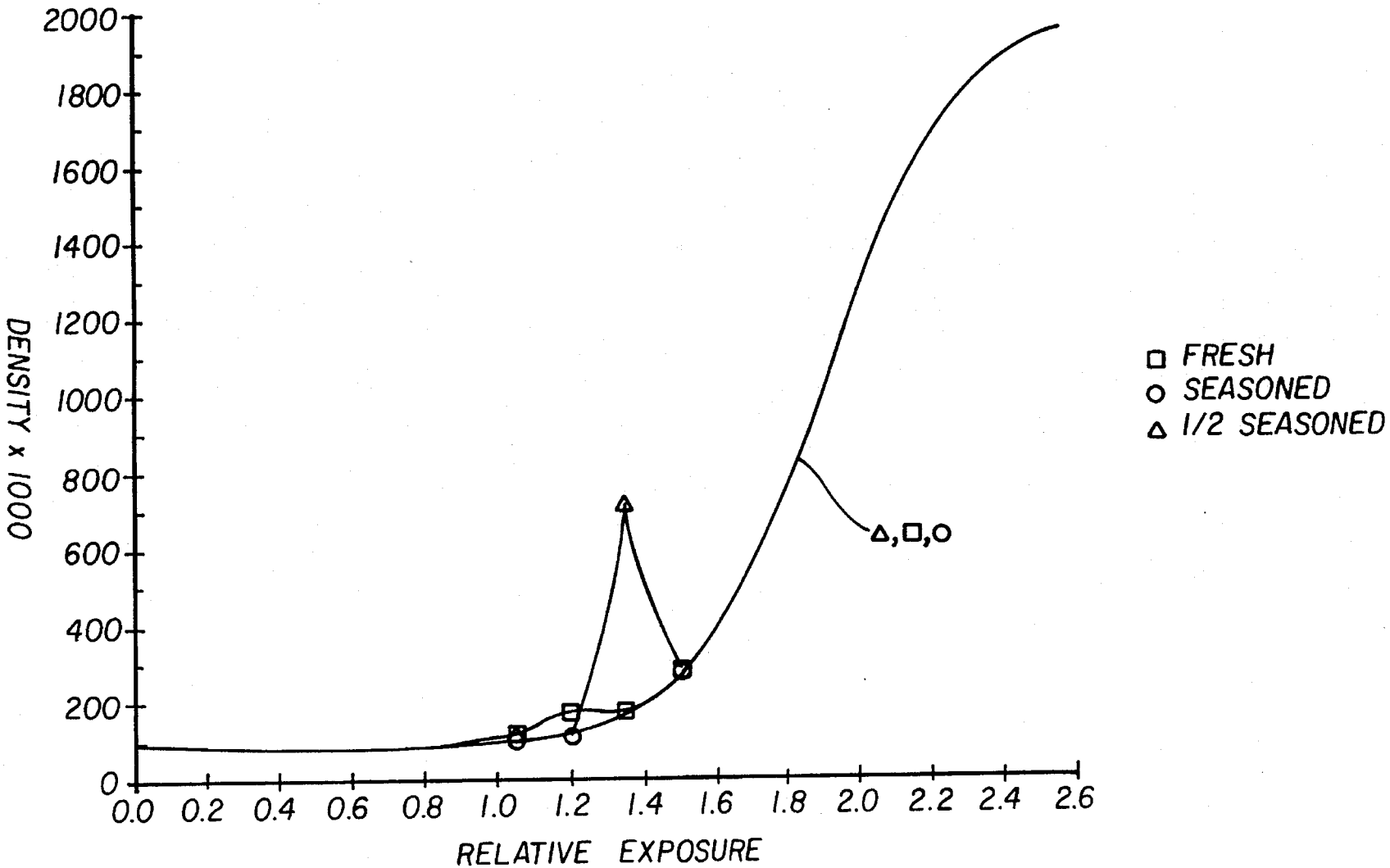
Figure 4:
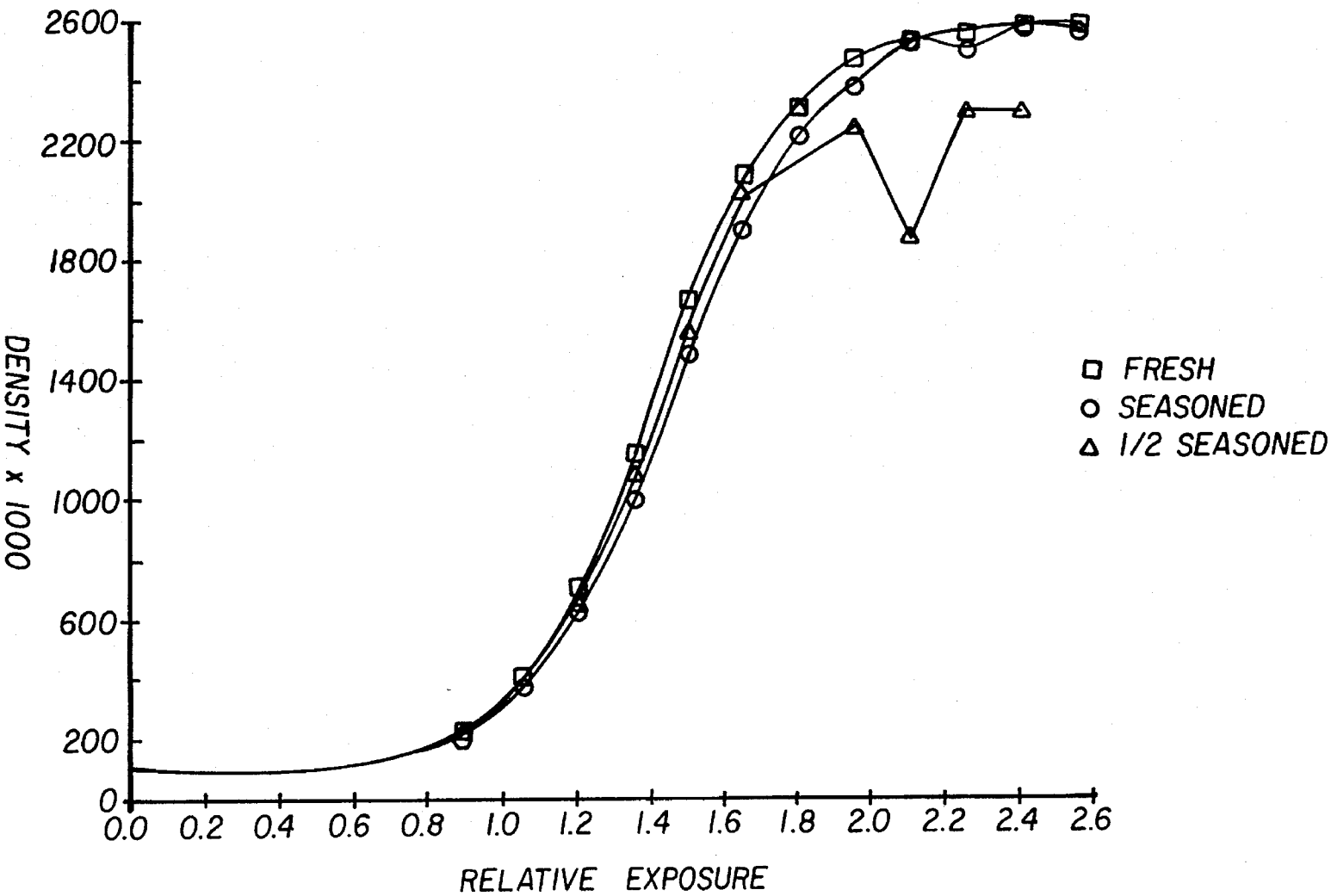

FIGS. 2, 3 and 4 show the sensitometry of the 3 colored layers. Allowing for errors in the reading, it is unlikely that these extremely small sensitometric changes would be observed in prints. Therefore the developer with the above initial starting formula can be used without replenishment to process 100, A4 sheets of this material without replenishment. The amount of solution used to process a square foot of paper is about 7 ml. If this developer solution were used as a replenisher, 162 ml/m$^2$ is usually used. Therefore a substantial saving on chemistry supply and waste is made.

Most activity loss of the bleach-fix is caused by dilution by developer carried into the bleach-fix on the photographic material. Activity loss effect by dilution was measured by measuring the bleach fix time at room temperature (20° C). This was done by observing the infra-red density change with time of a developed piece of test paper dipped in nitrogen agitated bleach-fix. The bleach-fix time was taken as the time when no further density change was observed.

The starting formula was as follows (this is similar to RA4 bleach-fix NR):

| | |
|---|---|
| 1.56M Ammonium iron(III) EDTA | 275 ml |
| Ammonium thiosulphate | 225 g |
| Sodium sulphite | 42 g |
| pH adjusted to 5.5 | |

Figure 5:
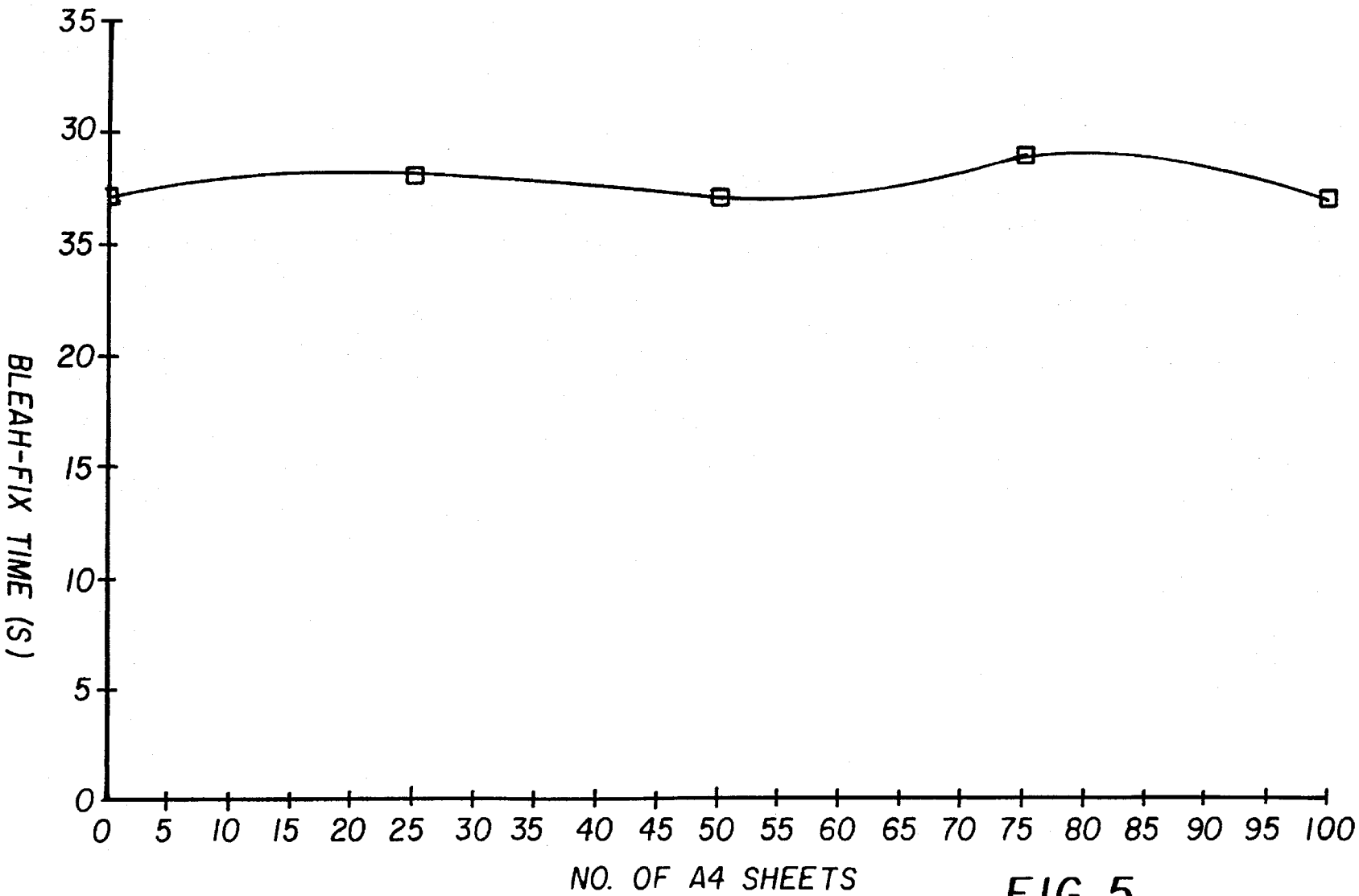

Samples of this were diluted with the developer described above and silver chloride added at levels that would correspond to the amount of silver in the bleach-fix after that much developer were carried in assuming a typical carry over rate of 32 ml/m$^2$. FIG. 5 shows the bleach-fix times for different numbers of processed sheets. At this level, 30 seconds bleach-fix time is not exceeded.

Figure 6:
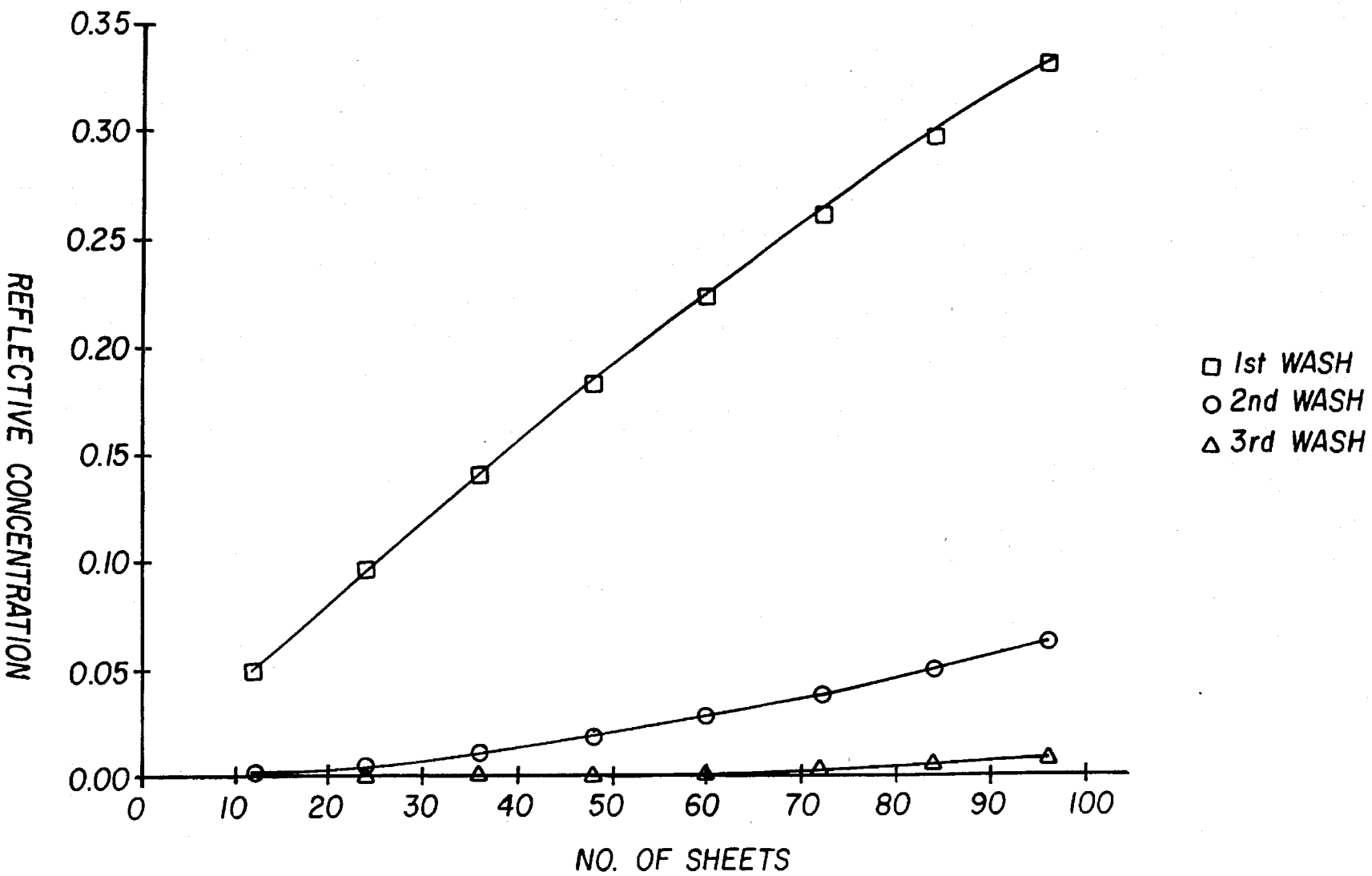
Figure 7:
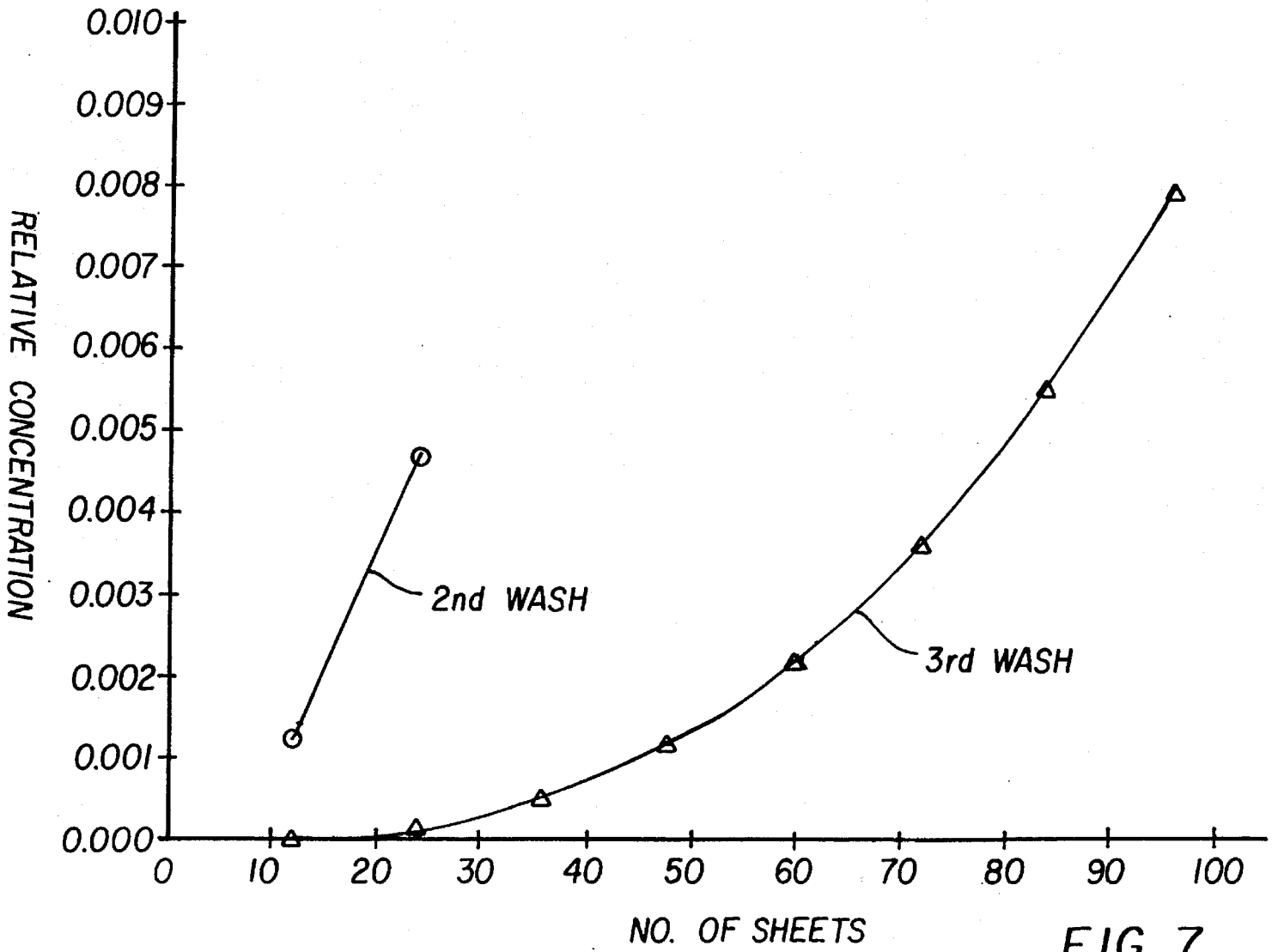

The wash water was modelled using a computer program that modelled the concentration of bleach-fix tank carried into subsequent wash tanks. FIGS. 6 and 7 show the relative concentrations of bleach-fix components after putting through different numbers of sheets. Again a carryover rate of 32 ml/m$^2$ was assumed. From the curve the amount of bleach-fix in the final wash can be calculated. A wash with this concentration of bleach-fix was made up.

It is believed that stain is likely to be the greatest problem caused by retained components taken in from the last wash. A piece of unexposed but processed paper (processed in a Model 25 processor filled with RA4 chemistry) was left for 2 minutes to soak in the simulated seasoned last wash. This was dried and put with a control of the original untreated processed paper, as a control, in an incubator at 60° C. and 60% humidity for 14 days. The densities of the strips before and after incubation were determined and tabulated below. It can be seen that there was no significant increase in the stain.

| | Before incubation | | | After incubation | | |
|---|---|---|---|---|---|---|
| | R | G | B | R | G | B |
| Untreated | .12 | .14 | .14 | .13 | .16 | .18 |
| Treated | .12 | .14 | .14 | .13 | .17 | .17 |

The invention has been described in detail with particular reference to preferred embodiments thereof, but it will be understood that variations and modifications can be effected within the spirit and scope of the invention.

I claim:

1. A method of processing an imagewise exposed photographic silver halide material in a machine containing a number of non-replenished processing tanks or processing tanks which are supplied from a non-replenished source wherein said photographic silver halide material comprises a silver halide emulsion comprising at least 95% by weight silver chloride, and processing in each processing tank is carried out with agitation of a processing solution in said processing tank, each of said processing solutions having a fixed volume and being circulated continuously or intermittently through respective processing tanks and sources of said processing solutions, but none of said processing solutions being replenished during said processing method.

2. The method of claim 1 in which said silver halide emulsion comprises at least 99% by weight silver chloride.

3. The method of claim 1 wherein said photographic material is a color photographic material, and in which said machine comprises processing tanks for developing, bleaching and fixing said color photographic material.

4. The method of claim 1 in which processing is carried out in a drum processor.

5. The method of claim 1 wherein said imagewise exposed photographic material is a black and white photographic material.

6. The method of claim 1 wherein each of said circulated processing solutions is circulated intermittently through said respective processing tanks and said processing solution sources.

7. The method of claim 1 wherein said photographic material is immersed during processing, and said machine has sufficient rollers so that the number of roller strikes on the surface of said immersed photographic material is >0.5/second.

8. The method of claim 1 wherein said photographic material is immersed during processing, and the surface of said immersed photographic material is contacted with a squeegee blade.

9. The method of claim 1 wherein said silver halide emulsion comprises less than 0.1% by weight of silver iodide.

10. The method of claim 1 wherein said photographic material is a color photographic paper.

11. The method of claim 1 wherein said circulated processing solutions are supplied from a replaceable solution supply unit comprising separate holder compartments for each processing solution.

* * * * *